US011512854B2

(12) United States Patent
Bassetti et al.

(10) Patent No.: US 11,512,854 B2
(45) Date of Patent: Nov. 29, 2022

(54) GAS COOKING ASSEMBLY AND A HOB COMPRISING THE SAME

(71) Applicant: ELECTROLUX APPLIANCES AKTIEBOLAG, Stockholm (SE)

(72) Inventors: Alex Bassetti, Forli (IT); Areli Uribe Portugal, Forli (IT); Riccardo Eusepi, Forli (IT); Fabio Rasi, Forli (IT); Ferdinando Vivacqua, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 139 days.

(21) Appl. No.: 17/040,795

(22) PCT Filed: Mar. 11, 2019

(86) PCT No.: PCT/EP2019/056019

§ 371 (c)(1),
(2) Date: Sep. 23, 2020

(87) PCT Pub. No.: WO2019/185341

PCT Pub. Date: Oct. 3, 2019

(65) Prior Publication Data

US 2021/0003287 A1 Jan. 7, 2021

(30) Foreign Application Priority Data

Mar. 26, 2018 (EP) ..... 18163925

(51) Int. Cl.
*F24C 3/08* (2006.01)
*F23D 14/84* (2006.01)

(52) U.S. Cl.
CPC ..... *F24C 3/085* (2013.01); *F23D 14/84* (2013.01); *F23D 2207/00* (2013.01); *F23D 2900/00003* (2013.01)

(58) Field of Classification Search
CPC ..... F24D 14/06; F24D 14/84; F24C 3/085
(Continued)

(56) References Cited

U.S. PATENT DOCUMENTS 5,938,425 A * 8/1999 Damrath ..... F23N 1/005 137/599.05
6,017,211 A 1/2000 Gort et al.
(Continued)

FOREIGN PATENT DOCUMENTS

EP 677705 10/1995
EP 2589879 5/2013
(Continued)

OTHER PUBLICATIONS

International Search Report and Written Opinion for PCT/EP2019/056019 dated May 20, 2019, 9 pages.

*Primary Examiner* — Vivek K Shirsat
(74) *Attorney, Agent, or Firm* — Peame & Gordon LLP

(57) ABSTRACT

A gas cooking assembly comprises: (a) a base part (10) comprising: (a1) a burner body (14) for installation in a cooktop surface (16); (a2) a gas outlet (20) in the burner body (14); and (a3) an ignition source (22) in the burner body (14); and (b) an upper part (12) comprising: (b1) at least one foot (36) for supporting the upper part (12) on the cooktop surface (16); (b2) a grate (26) for supporting a cooking vessel; (b3) an annular flame spreader (28); and (b4) a gas inlet (46) at the bottom side of the flame spreader (28); wherein the upper part (12) is an integral unit that is removable from the base part (10), wherein when the upper part (12) is connected to the base part (10), the gas inlet (46) of the upper part (12) connects to the gas outlet (20) of the base part (10).

18 Claims, 6 Drawing Sheets

(58) Field of Classification Search
USPC ..... 126/39 E, 39 L, 39 R
See application file for complete search history.

(56) References Cited

U.S. PATENT DOCUMENTS

| | | | | |
|---|---|---|---|---|
| 6,619,280 | B1 * | 9/2003 | Zhou | F23D 14/085 126/39 R |
| 2017/0067632 | A1 | 3/2017 | Angulo et al. | |
| 2017/0138605 | A1 * | 5/2017 | Cadima | F23D 14/065 |

FOREIGN PATENT DOCUMENTS

| | | |
|---|---|---|
| EP | 2592355 | 5/2013 |
| EP | 2737250 | 6/2014 |
| EP | 2896886 | 7/2015 |
| NL | 54923 | 2/1943 |
| WO | 2007107195 | 9/2007 |

* cited by examiner

GAS COOKING ASSEMBLY AND A HOB COMPRISING THE SAME

The present invention is directed to a gas cooking assembly and to a hob comprising the same.

Although many experienced cooks, irrespective of for domestic cooking or for commercial or gastronomical cooking, prefer gas cooking devices over electric or inductive cooking hobs, gas cooking devices often have difficulties to compete with glass ceramic hobs with electric or inductive heating in terms of ease and comfort of ease use, particularly under the aspect of flexibility and cleanability.

Thus gas cooking fields often require more effort for cleaning because, in contrast to electric or inductive glass ceramic hobs, a gas cooking field usually consists of several individual components, which when cleaning the hob have to be disassembled, individually cleaned, and then again reassembled.

EP 2 737 250 B1 addressed such problem by providing for a burner assembly having a central gas supply feeding a flame spreader which is fixedly connected to a grate for supporting a cooking vessel. While the grate either may be supported directly by the burner or may comprise supports legs that are connected to a base ring that rests on the cooktop surface, in all embodiments the burner has a centrally located feed duct that connects to a gas supply provided in the cooktop surface.

A similar approach is shown in EP 2 589 879 A1 which discloses a gas burner assembly in which a burner crown and a burner cap are attached to a cookware support so as to integrate the burner and the cookware support as a one-part-piece to facilitate handling. Similarly as in EP 2 737 250 B1, also the burner suggested in EP 2 589 879 A1 comprises a centrally located feed duct that connects to a gas supply provided in the cooktop surface. When it comes to flexibility, while in the field of glass ceramic hobs with electric or inductive heating it is quite common to provide for variable cooking zones, the size and/or shape of which can be varied, also in the field of gas cooking devices several attempts were made to provide for variable cooking zones.

Thus, in U.S. Pat. No. 6,017,211 A a gas cooking appliance was suggested having a cooktop surface and a plurality of gas burners, wherein for each burner there is provided a gas outlet in the cooktop surface, and wherein each burner comprises a circular burner nozzle having radial gas outlets, a gas inlet that is located off-center with respect to the circular shape of the burner nozzle, and two igniter openings for receiving an igniter fixedly provided in the cooktop surface, so that by rotating the burner nozzle by 180° about the gas inlet the position of the burner can be changed.

EP 0 677 705 A2 discloses a gas hob with a removable burner head which can be inserted in different positions, i.e. rotated by 90° or 180, so as to assume different working positions.

In EP 2 592 355 A1 and in EP 2 896 886 A1 there are disclosed hobs wherein a burner unit is mounted on a mechanical motion unit, in particular a motor driven turntable, so that the position of the heating element can be altered.

Furthermore, in US 20170067632 A1 there is disclosed a burner assembly for a cooktop having ring-shaped burner nozzle to which gas is provided by an eccentric gas supply along the ring, wherein the ring can be rotated about the gas supply to assume various positions.

While the above solutions that rely on mechanical motion units are quite complex and thus expensive to manufacture and, due to its mechanical components, are prone to wear and failure, the other solutions are disadvantageous in terms of handling and ease of use, since for moving the burner they all require a grate for supporting cooking vessels to be removed, the burner to be dislocated, and the grate to be reinstalled.

In view of the above, it is to be seen that there is room for improvement. The present invention aims to provide for a gas cooking assembly that provides for improvements in terms of handling and ease of use, and which particularly addresses both the issues of flexibility and cleanability.

In accordance with the present invention the above object is solved by a gas cooking assembly which comprises:

(a) a base part comprising:

(a1) a cooktop surface;

(a2) a gas outlet in the cooktop surface; and (a3) an ignition source in the cooktop surface; and (b) an upper part comprising:

(b1) at least one foot for supporting the upper part on the cooktop surface;

(b2) a grate for supporting a cooking vessel;

(b3) an annular flame spreader; and (b4) a gas inlet at the bottom side of the flame spreader;

wherein the upper part is an integral unit that is removable from the base part, wherein when the upper part is connected to the base part, the gas inlet of the upper part connects to the gas outlet of the base part.

The present invention thus provides for a burner assembly in which the upper part with the grate and the flame spreader is an integral unit which as a whole can be removed from and reinstalled to the base part, which facilitates handling of the device during removal, installation and cleaning, since only a single component is to be manipulated. Furthermore, given that the sole burner parts that are provided in the base part are the gas outlet and the ignition source, these elements can be provided in the cooktop surface in a manner that allows easy cleaning of the base part when the upper part has been removed.

The cleanability of the assembly can be further improved by adequate selection of the materials for the individual components. In that respect it should be noted that although the upper part is designed as an integral unit, the flame-spreader can be made from a different material than the grate or a burner cap that is formed with the grate. Thus, while the flame-spreader advantageously can be made for example of aluminum which facilitates high precision forming of the flame-spreader, such as to provide for minute gas outlet openings, the grate and any components formed therewith, such as a burner cap and/or legs for supporting the upper part, can be formed as a molded part which is provided with an easy to clean coating, such as an enamel coating.

Given that the sole elements to be connected when installing the upper part on the base part are the gas inlet and the gas outlet, the base part can be used with different upper parts, i.e. with upper parts that differ in the size and shape of the grate and/or that differ in the gas throughput of the flame spreader, i.e. in the power of the burner, but which all have a gas inlet of a common size and shape.

Furthermore, due to the flame spreader being an annular element, the gas inlet being not centrally located but eccentrically along the annular shape of the flame spreader, which allows positioning the upper part in different orientations with respect to the base part. Thus, the present invention for a gas cooking assembly which allows rotating the upper part, which when using more the gas cooking assembly with at least one further burner allows combining adjacent gas cooking zones so as to adapt the size and shape of the cooking zone to cooking vessels of different size and shape.

In particular, the grate may comprise an annular disk which interposes the flame spreader and which carries a plurality of bars for supporting a cooking vessel. In such embodiments, the annular disk of the grate provides a stable basis that interconnects the plurality of bars, which thus can be freely placed at any angular position of the annular disk, such as in a regular pattern of four bars that are arranged in a cross-like fashion, i.e. when measuring from a first bar at 90°, 180° and 270°. Of course also any other number and/or orientation of the bars is possible.

In such latter embodiments, a plurality of legs can be attached to the annular disk, wherein each leg has a foot for supporting the upper part on the cooktop surface. The grate thus can be configured as a stable stand-alone support, wherein the grate not only carries the cooking vessel, but also provides for the structural elements by which the upper part of the burner assembly an any cooking vessel placed thereon is supported by the cooktop surface.

In a particularly preferred embodiment, the bars for carrying a cooking vessel extend outwardly beyond the annular disk and merge into the legs, in which manner there can be provided for a large and stable supporting surface for carrying a cooking vessel and which at the same time provides for maximum stability for the standing of the legged grate on the cooktop surface, since the legs thus can be placed at a maximum distance to each other.

Advantageously, the legs can be are sized to provide for a distance between the flame spreader and the cooktop surface, so that the legs are the only elements of the upper part that are in contact with the cooktop surface, in which manner most part of the cooktop surface below the upper part remains free and thus is easy to clean after removal of the upper part.

The flame spreader can have a generally U-shaped cross-sectional shape having inner and outer annular walls with a plurality of recesses along the upper edge of the inner and/or outer wall. Together with a corresponding capping element that closes the U-shape at the top side, such as the bottom side of the grate to which the flame spreader directly abuts, or a cap ring which is interposed between the flame spreader and the grate, the internal volume of the U-shape forms a gas distribution chamber by which gas is passed from the gas inlet to the plural burner openings that are formed as recesses along the upper edge of the inner and/or outer wall. While the flame spreader thus can be configured selectively as a burner nozzle comprising a circular outwardly directed gas flow, as a burner nozzle comprising a circular inwardly directed gas flow, or as a burner nozzle that ejects two concentric flame rings, configuring the respective outlet openings as recesses along the upper edge of the inner and/or outer wall facilitates manufacturing of the flame spreader.

As already was mentioned above, the flame spreader can directly abut against the bottom side of the grate, in which case the grate also acts as cap element for closing the U-shape of the flame spreader.

In the alternative, there also can be provided a dedicated cap ring which is interposed between the flame spreader and the grate, wherein the cap ring rests on the upper edge of the inner and outer walls of the flame spreader.

Irrespective of whether the flame spreader abuts against the bottom side of the grate or a dedicated cap ring is interposed between the flame spreader and the grate, the grate or cap ring serves to close the upper open side of the U-shaped flame spreader so as to form a distribution chamber to which gas is supplied via the gas inlet and from which gas is ejected via the plurality of openings that are provided by the recesses along the upper edge of the inner and/or outer wall. Providing a dedicated cap ring can be advantageous in terms of controlling gas exit from the flame spreader. That is, for example when the grate is formed of enameled metal, the bottom side of the grate might not be sufficiently even to prevent uncontrolled gas exit at the location of contact between the flame spreader and the grate, in which case a dedicated cap ring can be provided, so as to reliably close the distribution chamber of the flame spreader. The cap ring can be made of a different material than the materials that are used for the flame spreader and/or the grate which allows using alternative manufacturing techniques that may provide for improved performance, such as better coupling of parts and/or higher precision in dimensional control of the parts.

The flame spreader can be attached to the grate by a plurality of clamps or bolts, so that the upper part comprising the at least one foot, the grate and the annular flame spreader, is reliably combined into an integral unit that can be handled as a single piece In order not to impede the gas flow through the annular spreader, the flame spreader can comprise a plurality of lugs that extend outside of the annular shape of the flame spreader and which are located below bars of the grate, wherein bolts extend through the lugs into the bars.

To provide for a connection between gas outlet and gas inlet, and at the same time to provide for means for facilitating the placement of the upper part with respect to the base part, the gas inlet can comprise a duct protruding downwards from the upper part, and the gas outlet of the base part can comprise a receptacle for insertion of said duct. When installing the upper part on the base part, the upper part is placed above the base part in a manner so that the protruding duct is oriented to coincide with the receptacle of the base part, whereupon the upper part is lowered to thus insert the duct into the receptacle.

In preferred embodiments, the gas outlet of the base part protrudes upwards from the base part, so that the upper edge of the gas outlet is located above the cooktop surface. When the device is to be cleaned with the upper part having been removed from the base part, the cooktop surface with the base part thus can be safely wetted with cleaning liquid without risk of water flowing into the gas outlet. Providing for a raised configuration of the gas outlet further can facilitate aligning the upper part with respect to the base part, since thus both the duct of the upper part and the corresponding receptacle of the base part can be easily haptically located and thus serve as locator elements that facilitate the alignment.

The duct and the receptacle can be shaped to allow insertion of the duct into the receptacle only at a predetermined orientation of the upper part with respect to the base part. The duct and the receptacle thus not only act as locator elements, but also ensure proper angular orientation of the upper part with respect to the base part. It should be understood that in such embodiments the predetermined orientation needs not be a single orientation, but also may comprises a plurality of orientations, such as an orthogonal pattern of orientations in which the upper part, starting from a first orientation, selectively can be located turned by 90°, by 180° or by 270°.

In such embodiments the duct and the receptacle can have a cross-sectional shape which has a single axis of symmetry, so as to allow insertion of the duct into the receptacle only at two predetermined orientations of the upper part with respect to the base part, so that the upper part selectively can be set onto the base part in a first orientation and in a second orientation in which the upper part is rotated by 180° with respect to the first orientation.

Restricting the orientation of the upper part to a first orientation and to a second orientation in which the upper part is rotated by 180° with respect to the first orientation has the advantage that in such embodiments the duct and the receptacle can be given a lengthy shape, such as a an oblong shape or a generally rectangular shape, optionally with rounded corners, in which the longer axis extends tangentially to the annular shape of the flame spreader which allows for a substantially larger cross-section, and hence flow area, of the gas supply duct, as if the duct and the receptacle have a, for example, circular shape. Furthermore, the duct can have a shape that itself influences the flow characteristics of the fuel gas-air mixture as it is passed via the duct to the distribution chamber of the flame spreader, such as selecting a shape for the interior wall of the duct which provides for a Venturi effect on the gas air mixture as it passes through the duct. Thus, the duct can have a shape which provides for a constriction or throat along the length of the duct, so that the fuel gas-air mixture is accelerated when passing the duct.

The base part further can comprise an adjustable Venturi assembly for control of the flow of air that is used in the mixture of fuel gas and air which is fed via the distribution chamber to the plurality of gas outlet openings. In order to allow installation of the burner assembly in a kitchen bench without any parts protruding beyond the thickness of the bench, the adjustable Venturi assembly preferably is configured for horizontal installation. The adjustable Venturi assembly can be designed to draw in primary air from the ambient of the burner assembly under the cooktop surface. Upon mixing such air with fuel gas that is supplied from a gas supply, the fuel gas-air mixture flows upwards through the vertical inlet duct into the distribution chamber of the flame-spreader.

To shut off the gas flow to the gas cooking assembly in case that the burner flame extinguishes, such as by an unintended interruption of the gas supply, a strong air flow, or liquid spilling over the burner assembly, the base part further may comprise a thermocouple for providing a flame signal indicating that the burner flame is ignited, and a safety valve for shutting off the gas supply if the thermocouple no longer provides the flame signal. In such embodiments the thermocouple senses the temperature near the burner nozzle. If it is determined that the temperature has fallen below a preset minimum temperature, it is assumed that the burner flame no longer is burning and hence the gas supply is shut off by the safety valve.

The gas cooking assembly of the present invention can be used in a hob in combination with at least one further gas burner which either may be a conventional fixed gas burner or another gas cooking assembly of the present invention, so that by changing the orientation of the gas cooking assembly of the present invention the distance between the at least two gas burners can be varied, such as to selectively provide for two individual cooking zone, or to provide for one combined cooking zone for heating larger lengthy cooking vessels.

Thus, a hob may comprise two gas burners, on which at least one is a gas cooking assembly as suggested herein, which is located such that the gas inlet is located at a distance to the second burner so that the grates of the two gas burners selectively can be placed adjacent to each other to form a combined cooking zone, or the upper part of the inventive gas cooking assembly can be turned by 180° so that its grate is located at a larger distance to the second burner. When drawing a line through the centers of the burners, the gas inlet of the rotatable burner assembly thus would be placed on such line facing away from the second gas burner.

Similarly, in a hob having three gas cooking zones, the burners may be arranged to be located along a line passing through the centers of the burners, wherein the middle one can be located such that the gas inlet is located 90° above or below the connection line, so that by rotating the middle burner, the burner can be placed so as to form a triangle. Further, one or two of the burners to the left and to the right can be oriented such that the gas inlet is located on the said connection line at a distance that such burner selectively can be placed proximal to the middle burner, so as to form a combined cooking zone.

The present invention is described in further detail below by reference to the drawings in which.

Figure 1:
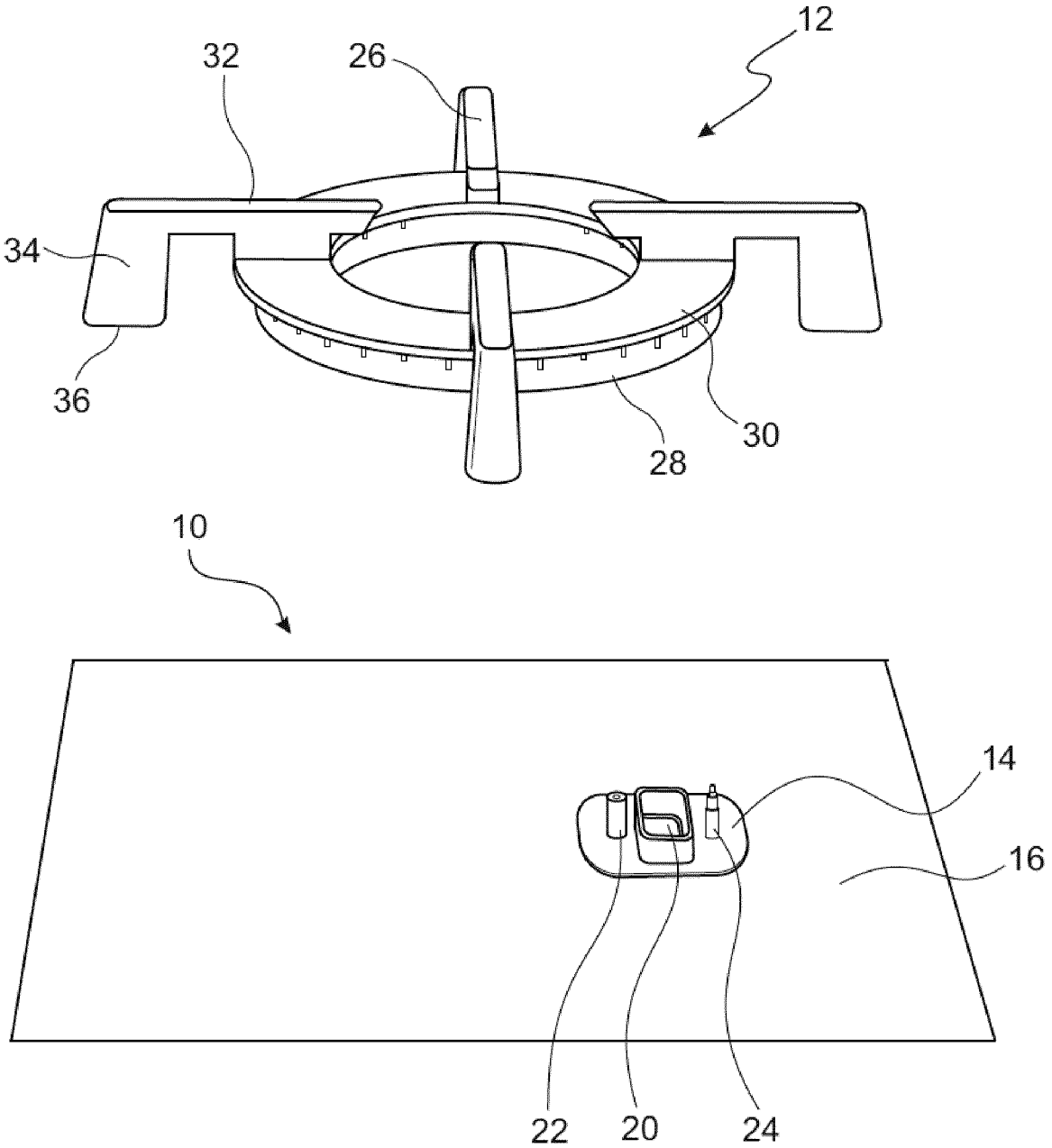
FIG. 1 is a perspective view of a gas cooking assembly in accordance with the present invention.
Figure 2:
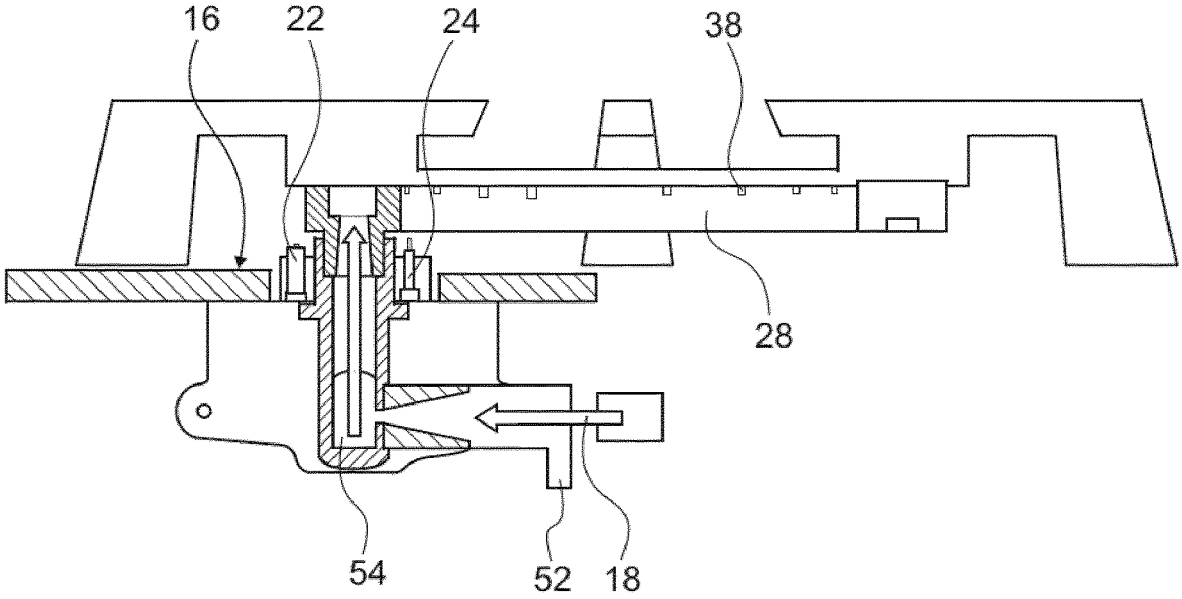
FIG. 2 is a side view illustrating the gas cooking assembly shown in FIG. 1.

FIG. 1 illustrates in perspective view a gas cooking assembly in accordance with the present invention. The gas cooking assembly comprises a base part 10 and an upper part 12. The base part 10 which may be part of a hob comprises a burner body 14 which is installed from the bottom side of a cooktop surface 16, which may be for example a glass ceramic plate. In its base portion that is located below cooktop surface 16, the burner body comprises means for controlling gas flow, such as a an adjustable Venturi assembly 18 that is configured to control the air flow to the burner, so as to control the amount of air feed in order to control the mixing ratio of fuel gas and air. As schematically illustrated in FIG. 2, the adjustable Venturi assembly 18 preferably is oriented horizontally in the burner body 14, so as to control the flow of gas that is fed to the adjustable Venturi assembly 18 via a gas line 52 to a vertical duct 54 which feeds a gas outlet 20 that is provided in an upper portion of the burner body 14. As can be seen in FIGS. 1 to 4, in addition to the gas outlet 20, the base part 10 comprises an ignition source 22, such as a piezoelectric spark plug, and a thermocouple 24 for sensing temperature, which elements all are mounted so as to project upwardly beyond the level of the cooktop surface 16.

Upper part 12 comprises a grate 26 for supporting a cooking vessel and an annular flame spreader 28 which is mounted at the bottom side of an annular cap element 30 that is integrally connected with the grate 26. In the embodiment shown in the drawings, grate 26 comprises four bars 32 which are arranged in a cross-like fashion and which extend outwardly beyond the cap element 30 so as to provide for a stable support for a cooking vessel. At their outer ends, bars 32 merge into downwardly extending legs 34 each of which terminates in a foot 36 having a flat horizontal bottom surface with which the foot rests in the cooktop surface 16.

The cap ring 30 and the grate 26 can be formed as an integral part, and thus for example can be formed as a cast iron part which is provided with an enamel coating. Flame spreader 28 can be made of the same or a different material than the grate. In the embodiments shown herein, flame spreader 28 is a U-shaped aluminum ring which as can be best seen in FIGS. 3 and 4 has a plurality of recesses 38 along the inner and outer walls 40, 42. The space between inner wall 40 and outer wall 42 forms a gas distribution chamber 44, via which a fuel gas-air mixture is passed from a gas inlet 46 to the plurality of recesses 38.

Figure 3:
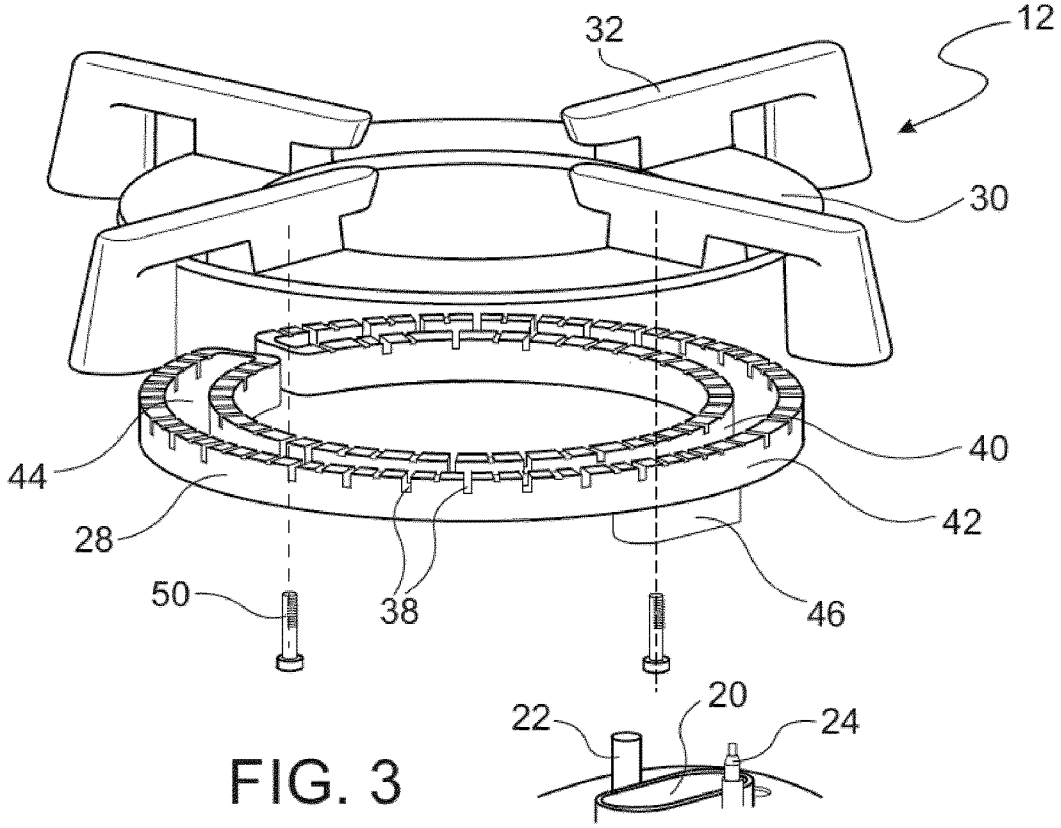
FIG. 3 is a perspective view illustrating the upper part of the gas cooking assembly shown in FIGS. 1 and 2.
Figure 4:
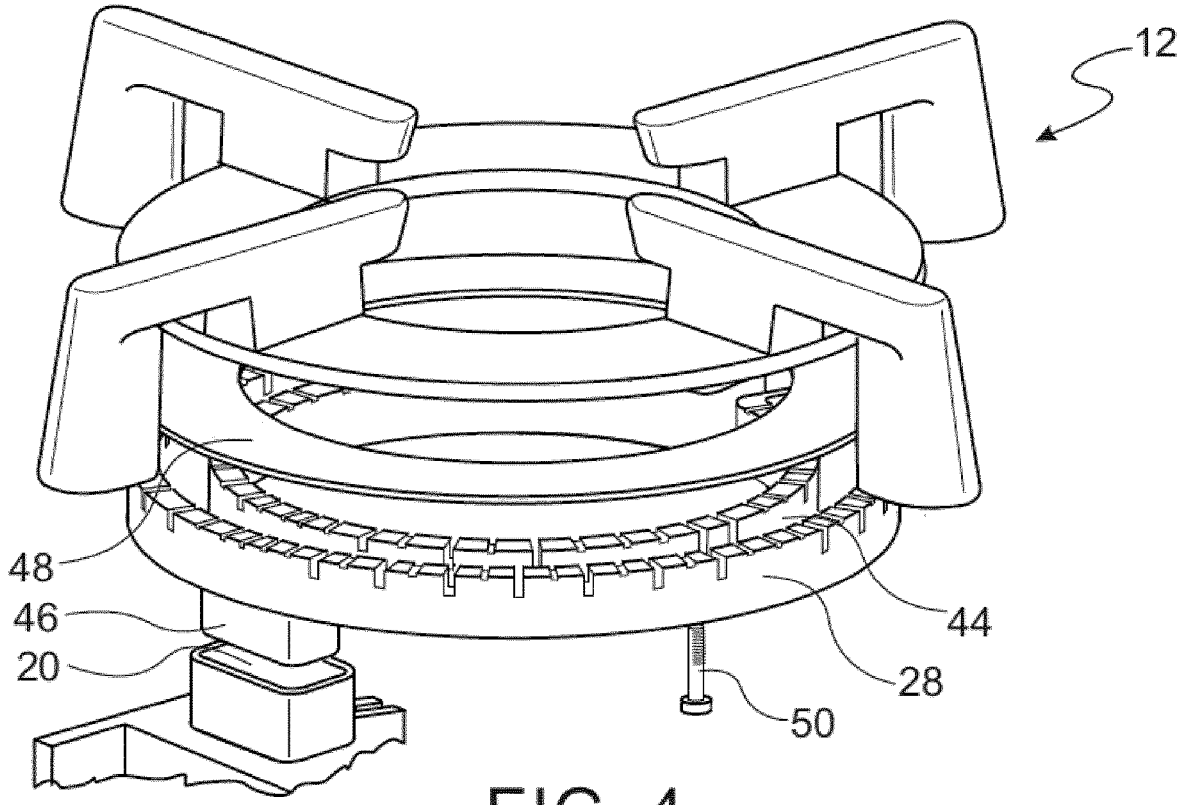
FIG. 4 is a perspective view illustrating an alternative embodiment of the upper part of the gas cooking assembly shown in FIGS. 1 and 2.

While in the embodiment shown in FIG. 3, the flame spreader 28 directly abuts with the upper faces of the inner and outer walls 40, 42 against the bottom side of cap ring 30 of the grate 12, in the embodiment shown in FIG. 4 a separate cap ring 48 is interposed between the flame spreader 28 and the grate 12. The cap ring 48 rests on the upper edges of the inner and outer walls 40, 42 of the flame spreader 28 and thus forms a top wall for the gas distribution chamber 44.

As further can be best seen in FIGS. 3 and 4, the flame spreader 28 and the grate 12 are fixedly connected to each other by means of a plurality of bolts 50 which extend through the flame spreader 28 into threads that are formed in bars 32 of the grate 12. Of course the flame spreader 28, the grate 12 and optionally the separate cap ring 48 also can be fixed to each by other releasable or permanent fixing means, such as by clamps, by form-fit or by welding or brazing. In case that bolts are used for providing for the connection, the flame spreader can be provided with lugs that extend outside of the annular shape of the flame spreader 28 and which are located below the bars 32 of the grate 12, so that the bolts do not obstruct the gas flow within the gas distribution chamber 44.

Figure 5:
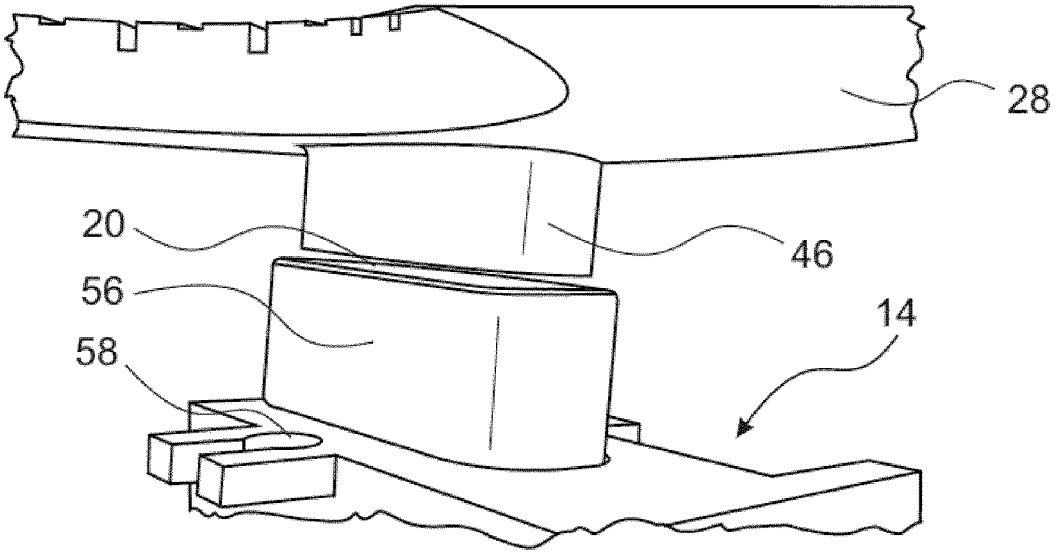
FIG. 5 shows the gas connection between the upper part and the base part.
Figure 6A:
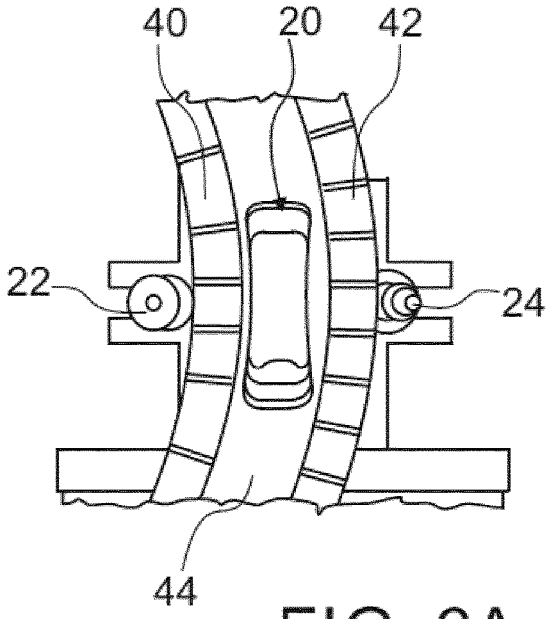
FIGS. 6A and 6B show the gas connection between the upper part and the base part when viewed from above in different positions of the upper part.
Figure 6B:
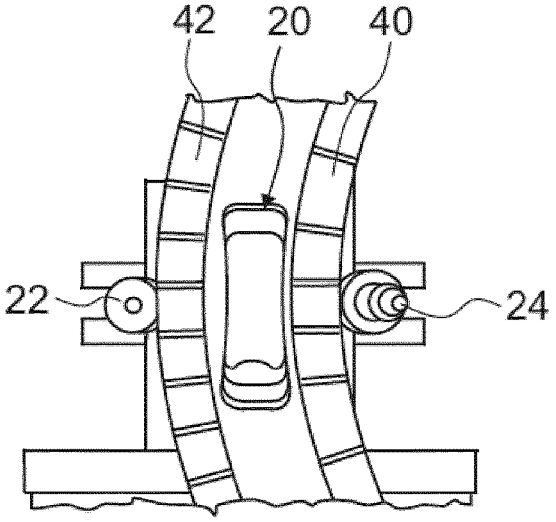

FIG. 5 illustrates in detail the gas connection between base part 10 and upper part 12. Flame spreader 28 of upper part 12 has a gas inlet duct 46 protruding downwards from the flame spreader 28. With gas inlet duct 46 having an oblong cross-sectional shape, burner body 14 of the base part 10 comprises a receptacle 56 of corresponding oblong inner cross-sectional shape for insertion of the gas inlet duct 46. As shown in FIGS. 6A and 6B the gas inlet duct 46 and the receptacle 56 which comprises the gas outlet 20 of the base part 10 have an oblong shape, the longer side of which has a curvature that corresponds to the shape of the inner wall 40. In order to allow rotation of the upper part 12 by 180°, so that the upper part 12 can be rotated from the position shown in FIG. 6A by 180° so as to assume the orientation shown in FIG. 6B, the gas inlet duct 46 and the receptacle 56 with the gas outlet 20 also along the outer wall 42 has a curvature that corresponds to the shape of the inner wall 40, so that the duct has a shape that is symmetric both about an axis that extends along the longitudinal direction of the duct as well as about an axis that extends along the short direction of the duct. For use in a standard domestic cooking hob, the gas inlet duct typically will have a length of about 20 to 28 mm and a width of 3 to 9 mm, which provides for an open cross-sectional area that is well sufficient for implementing gas throughput rates as they are typical for gas burners of cooking hobs.

While ignition source 22 and thermocouple 24 can be integrated into burner body 14, FIG. 5 shows an embodiment, in which to facilitate installation of ignition source 22 and thermocouple 24, burner body 14 is provided with clamps 58 that are located on both sides of receptacle 56.

As will be readily understood from the above, the present invention provides for an easy to use burner assembly in which the flame spreader is joined with the grate to form an integral unit which can be completely removed from the cooking top, while the spark plug and the thermocouple remain installed in the cooktop, as is also illustrated in FIGS. 6A and 6B.

Figure 7:
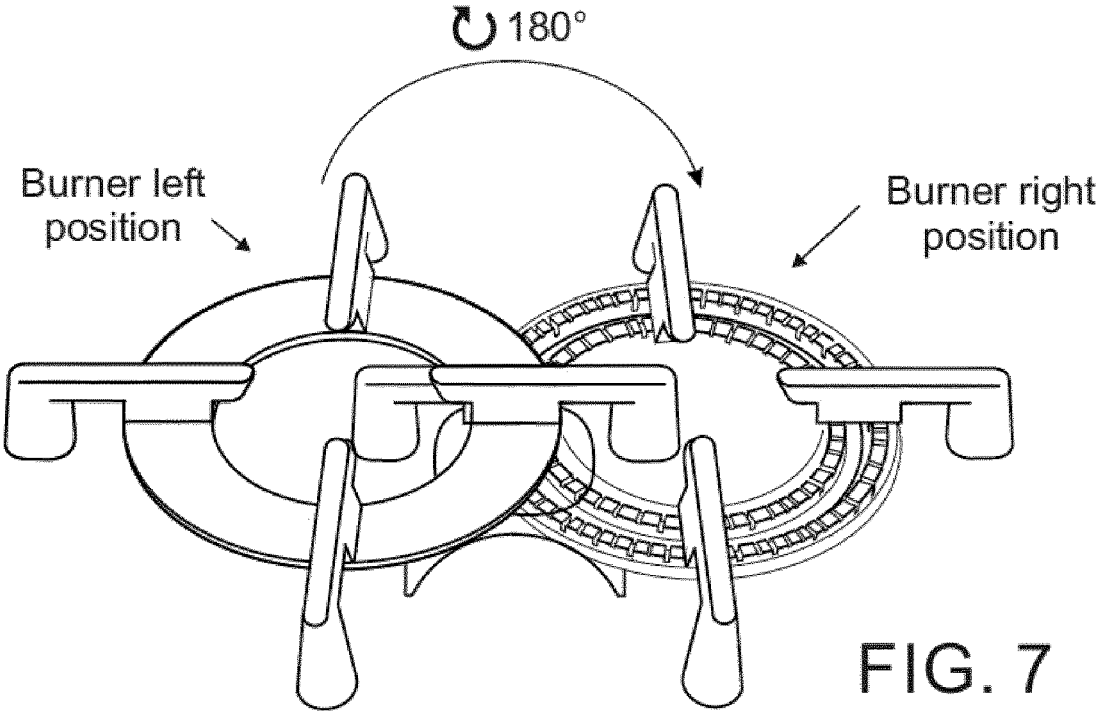
FIG. 7 illustrates rotation of the gas cooking assembly in accordance with the present invention.

When setting upper part 12 onto base part 10, gas inlet duct 46 and receptacle 56 serve as locator elements which assist the user in locating the correct position for installation of the burner assembly upper part 12. That is, with gas inlet duct 46 and receptacle 56 in the installed position of the upper part 12 at the base part 10 overlapping for a certain distance, when installing the burner upper part 12, it is held above the base at the position where the gas inlet duct 46 overlaps the receptacle 56, which position can be easily found since both these parts protrude towards each other, and then the upper part 12 is lowered so as to insert gas inlet duct 46 into the receptacle 56. Due to the symmetric cross-sectional shape of gas inlet duct 46 and receptacle 56, the upper part 12 can be selectively set onto the base part 10 in one of two positions, as it is illustrated in FIG. 7. When used in combination with at least one further gas burner, the burner assembly thus allows varying the size and shape of the cooking zones provided by these burners.

Figure 8A:
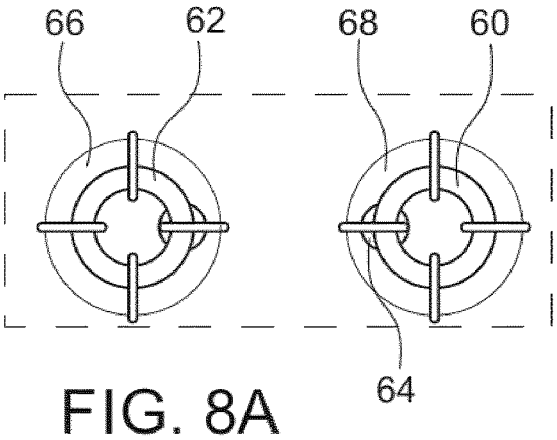
FIGS. 8A and 8B illustrate a hob or a portion thereof, with two gas cooking assemblies in different operating positions.
Figure 8B:
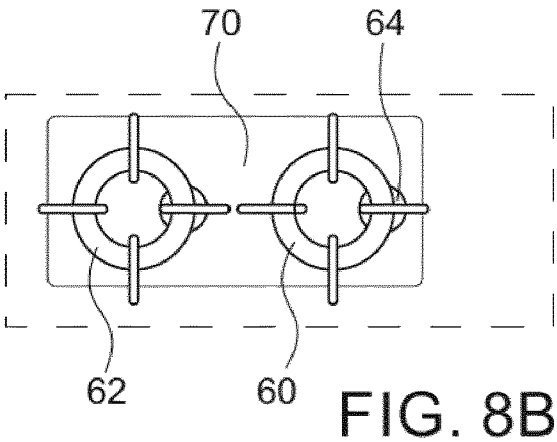

FIGS. 8A and 8B illustrate an example of employing a gas cooking assembly as it suggested herein as a rotatable burner 60 in combination with a further burner assembly 62, which either may be a fixed burner or also a rotatable burner. In the situation shown in FIG. 8A the upper part 12 of burner assembly 62 is positioned such that it is positioned on its base part in the position shown in FIG. 7 as "burner right position", in which the gas inlet 64 is located on a line that extends through the centers of rotatable burner 60 and of the further burner assembly 62, wherein the gas inlet 64 is located to the left of the center of rotatable burner 60. In this position rotatable burner 60 and the further burner assembly 62 are located at a distance to each other so as to constitute two separate cooking zones which in FIG. 8A are marked by circles 66 and 68.

By removing upper part 12 of rotatable burner 60, turning it by 180° and again placing it onto the gas outlet so that the gas inlet 64 is located to the right of the center of rotatable burner 60, the grates of rotatable burner 60 of further burner assembly 62 are located adjacent to each other, so that these burners form a combined cooking zone 70 for heating larger lengthy cooking vessels.

Figure 9A:
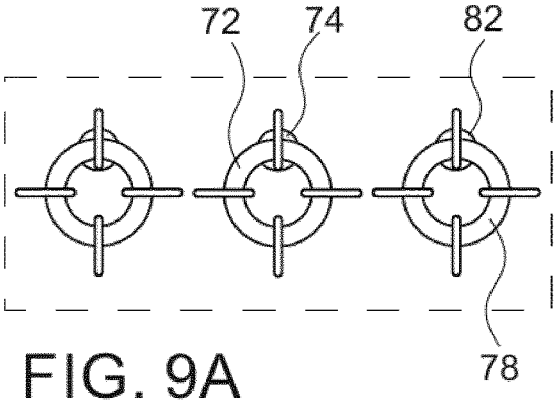
FIGS. 9A and 9B illustrate a hob or a portion thereof, with three gas cooking assemblies in different operating positions.
Figure 9B:
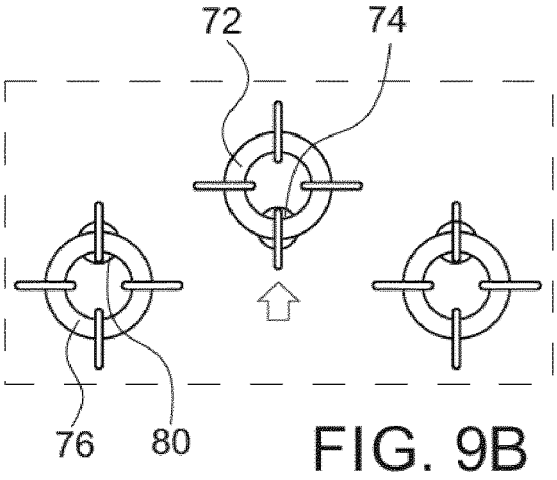

Similarly, in a hob having at least three gas burners, as is illustrated in FIGS. 9A and 9B, the three gas burners can be selectively combined into one large lengthy cooking zone (see FIG. 9A), or, by turning the middle burner assembly 72 by 180° about its gas inlet 74, the three burner assemblies can be separated from each other so as to constitute three independent cooking zones or one large triangular cooking for heating a large cooking vessels that is set on all three burners (see FIG. 9B).

Figure 10A:
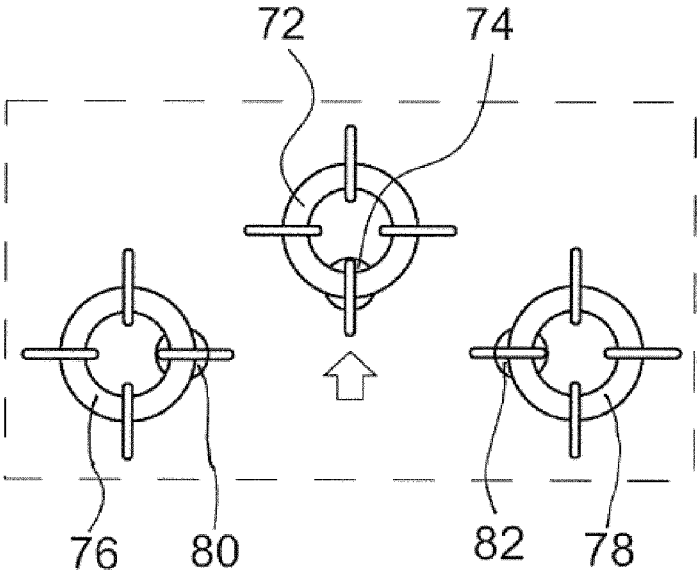
FIGS. 10A and 10B illustrate a further embodiment hob or a portion thereof, with three gas cooking assemblies in different operating positions.
Figure 10B:
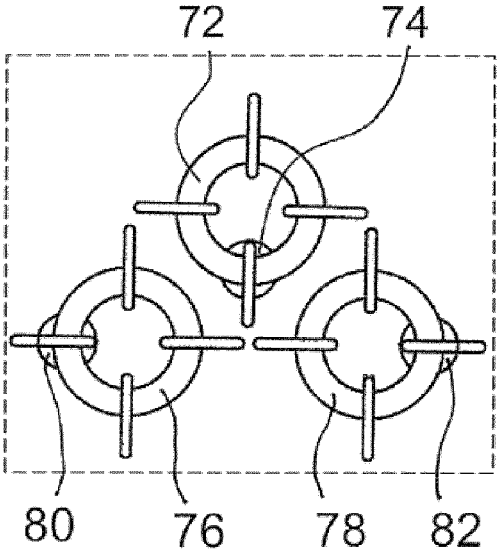

When further also the left burner assembly 76 and the right burner assembly 78 are configured as rotatable burner assemblies, wherein the gas inlet 80 of the left burner assembly 76 and the gas inlet 82 of the right burner assembly 78 are located in the position shown in FIG. 10A on a line that extends through the centers of left burner assembly 76 and of right burner assembly 78, wherein in the situation shown in FIG. 10A the gas inlet 80 of the left burner assembly 76 is located to the right of the center of left burner assembly 76 and the gas inlet 82 of the right burner assembly 78 is located to the left of the center of right burner assembly 78, by turning left burner assembly 76 by 180° about gas inlet 80 and turning right burner assembly 78 by 180° about gas inlet 82, the three burner assemblies 72, 76 and 78 can be combined into a triangular cooking zone for the heating of larger circular vessels in which the three burner assemblies 72, 76 and 78 are located close to each other as it is illustrated in FIG. 10B.

As will be readily understood, there are various further options of providing for flexible cooking zones by combining one or more of the rotatable burner assemblies suggested herein one or more further burner assemblies, which either also can be rotatable burner assemblies or the location of which is fixed with respect to the cooktop surface.

LIST OF REFERENCE SIGNS

10 base part
12 upper part
14 burner body
16 cooktop surface
18 adjustable Venturi assembly
20 gas outlet
22 ignition source
24 thermocouple
26 grate
28 flame spreader
30 cap element
32 bar
34 leg
36 foot
38 recess
40 inner wall
42 outer wall
44 gas distribution chamber
46 gas inlet
48 cap ring
50 bolt
52 gas line
54 vertical duct
56 receptacle
58 holder
60 rotatable burner
62 additional burner
64 gas inlet of 60
66 left cooking zone
68 right cooking zone
70 combined cooking zone
72 middle burner assembly
74 gas inlet of 72
76 left burner assembly
78 right burner assembly
80 gas inlet of 76
82 gas inlet of 78

The invention claimed is:

1. A gas cooking assembly comprising:
(a) a base part comprising:
(a1) a burner body for installation in a cooktop surface;
(a2) a gas outlet in the burner body; and
(a3) an ignition source in the burner body; and
(b) an upper part comprising:
(b1) at least one foot for supporting the upper part on the cooktop surface;
(b2) a grate for supporting a cooking vessel;
(b3) an annular flame spreader; and
(b4) a gas inlet at a bottom side of the flame spreader;
wherein the upper part is an integral unit that is removable from the base part, wherein when the upper part is connected to the base part, the gas inlet of the upper part connects to the gas outlet of the base part,
wherein the gas inlet of the upper part comprises a duct protruding downwards from the upper part and the gas outlet of the base part protrudes upwards from the base part so that an upper edge of the gas outlet is located above the cooktop surface, and
wherein said gas inlet duct and said gas outlet are slidingly engageable so as to establish fluid communication therebetween when so engaged.

2. The gas cooking assembly of claim 1, wherein the grate comprises an annular disk which interposes the flame spreader and which carries a plurality of bars for supporting a cooking vessel.

3. The gas cooking assembly of claim 2, wherein a plurality of legs are attached to the annular disk, each said leg having a foot for supporting the upper part on the cooktop surface.

4. The gas cooking assembly of claim 3, wherein the bars extend outwardly beyond the annular disk and merge into the legs.

5. The gas cooking assembly of claim 3, wherein the legs are sized to provide for a distance between the flame spreader and the cooktop surface.

6. The gas cooking assembly of claim 1, wherein the flame spreader has a generally U-shaped cross-sectional shape having inner and outer annular walls with a plurality of recesses along an upper edge of the inner and/or outer wall.

7. The gas cooking assembly of claim 6, wherein the flame spreader directly abuts against a bottom side of the grate.

8. The gas cooking assembly of claim 6, further comprising a cap ring interposed between the flame spreader and the grate, wherein the cap ring rests on the upper edge of the inner and outer walls of the flame spreader.

9. The gas cooking assembly of claim 1, wherein the flame spreader is attached to the grate by a plurality of clamps or bolts.

10. The gas cooking assembly of claim 9, wherein the flame spreader comprises a plurality of lugs extending outside of the annular shape of the flame spreader and which are located below bars of the grate, wherein bolts extend through the lugs into the bars.

11. The gas cooking assembly of claim 1, wherein the duct and the gas outlet are shaped to allow insertion of the duct into the gas outlet only at a predetermined orientation of the upper part with respect to the base part.

12. The gas cooking assembly of claim 11, wherein the duct and the gas outlet have a cross-sectional shape which has a single axis of symmetry, so as to allow insertion of the duct into the gas outlet only at two predetermined orientations of the upper part with respect to the base part.

13. The gas cooking assembly of claim 1, wherein the base part further comprises an adjustable Venturi assembly for control of a gas-air mixture that is passed to the gas outlet.

14. The gas cooking assembly of claim 1, wherein the base part further comprises a thermocouple for providing a flame signal indicating that a burner flame is ignited, and a safety valve for shutting off a gas supply if the thermocouple no longer provides the flame signal.

15. A hob comprising at least two gas burners, at least one of which is the gas cooking assembly as defined in claim 1, the base part of which is positioned at a distance to at least one further gas burner, so that the upper part can be selectively positioned either at close proximity or at a larger distance to the at least one further gas burner.

16. A burner assembly comprising:

a base part adapted to be mounted at or adjacent to a cooktop surface and having a vertical duct extending upward, a thermocouple and an ignition source, the vertical duct having a substantially symmetrical cross-section and being in communication with a gas source; and an upper part comprising a grate, a flame spreader and a cap ring all fixedly connected together as a single assembled element, the flame spreader comprising inner and outer annular walls spaced apart from one another and defining an annular distribution chamber therebetween, at least one of the inner and outer annular walls having a plurality of flame ports therein, a gas inlet duct extending downward from an underside of said flame spreader and being in fluid communication with said annular distribution chamber, the grate comprising a plurality of bars adapted to support a cooking utensil placed thereon, said cap ring being interposed between the grate bars and the flame spreader such that an underside surface of said cap ring rests on upper edges of the first and second annular walls so as to define an upper wall of said annular distribution chamber, a plurality of legs being attached to or formed with said grate bars and extending downward therefrom and adapted to support the upper part on said cooktop surface;

said gas inlet duct having a shape and a cross-section that are complementary to said vertical duct such when said gas inlet duct and said vertical duct are registered and said legs of said upper part are resting on said cooktop surface, said gas inlet duct and said vertical duct are slidingly engaged so as to establish fluid communication between said gas source and said distribution chamber;

said upper part being reversibly positioned on said cooktop as said single assembled element so as to establish said fluid communication between said gas source and said gas distribution chamber.

17. The burner assembly according to claim 16, said upper part being positionable in opposing positions relative to said vertical duct corresponding to respective orientations of said upper part that are 180° rotationally offset with one another, said gas inlet duct and said vertical duct being registered and slidingly engaged in both said opposing positions to establish said fluid communication between said gas source and said gas distribution chamber, said upper part being thereby adapted to selectively and reversibly define either: a common cooking zone together with another adjacent burner assembly on the cooktop, or two distinct cooking zones, one each for the burner assembly and said adjacent burner assembly on the cooktop.

18. The burner assembly according to claim 17, said gas inlet duct and said vertical duct being registrable in only said opposing positions of said upper part relative to said vertical duct on account of their shape and cross-sectional symmetry, said cap ring and said grate being supplied as separate components that are connected together.

* * * * *